US005473354A

United States Patent [19]

Arquilevich et al.

[11] Patent Number: 5,473,354

[45] Date of Patent: Dec. 5, 1995

[54] INK-DELIVERY APPARATUS

[75] Inventors: Dan Arquilevich, Vancouver, Wash.; Donald E. Wenzel, Albany, Oreg.

[73] Assignee: Hewlett-Packard Company, Palo Alto, Calif.

[21] Appl. No.: 258,270

[22] Filed: May 26, 1994

[51] Int. Cl.[6] ..... B41J 2/175

[52] U.S. Cl. ..... 347/85

[58] Field of Search ..... 347/85, 84, 94, 347/86; 138/111, 115, 137, 138, 139

[56] References Cited

U.S. PATENT DOCUMENTS

| | | | |
|---|---|---|---|
| 2,916,055 | 12/1959 | Brumbach | 138/111 |
| 4,412,233 | 10/1983 | Thomas et al. | 346/140 R |
| 4,437,104 | 3/1984 | Hudson | 346/140 R |
| 4,452,141 | 6/1984 | Mistyurik | 101/348 |
| 4,502,054 | 2/1985 | Brescia et al. | 346/75 |
| 4,534,289 | 8/1985 | Durrnagel et al. | 101/348 |
| 4,555,718 | 11/1985 | Aiba et al. | 346/140 R |
| 4,600,927 | 7/1986 | Sugitani | 346/1.1 |
| 4,665,409 | 5/1987 | Behrens et al. | 346/140 R |
| 4,689,641 | 8/1987 | Scardovi et al. | 346/140 R |
| 4,791,438 | 12/1988 | Hanson et al. | 346/140 R |
| 4,970,534 | 11/1990 | Terasawa et al. | 346/140 R |
| 5,025,270 | 6/1991 | Umezawa | 347/85 |
| 5,043,746 | 8/1991 | Abe | 347/85 |
| 5,245,365 | 9/1993 | Woodard et al. | 346/140 R |
| 5,282,419 | 2/1994 | Barrois | 101/367 |
| 5,360,037 | 11/1994 | Lindstrom | 138/138 |

FOREIGN PATENT DOCUMENTS

| | | | |
|---|---|---|---|
| 2485991 | 1/1982 | France . | |
| 2736084 | 2/1978 | Germany | 138/111 |
| 3436774 | 4/1986 | Germany | 138/111 |
| 3921037A1 | 6/1989 | Germany . | |
| 57-83488 | 11/1980 | Japan . | |
| 83488 | 5/1982 | Japan . | |
| 54879 | 3/1984 | Japan | 138/138 |
| 262652 | 12/1985 | Japan . | |
| 288045 | 12/1987 | Japan | 347/85 |
| 111555 | 4/1990 | Japan | 347/85 |
| 627031 | 7/1949 | United Kingdom | 138/111 |

*Primary Examiner*—N. Le

[57] ABSTRACT

A thin sleeve covering multiple, flexible ink-delivery tubes connecting ink sources to a reciprocable carriage-mounted printhead in an ink-jet printer is sealed around each tube preventing any tube from physically interacting with any other tube. The sleeve provides structural support for the tubes and eliminates entangling of the tubes. In addition, the sleeve can minimize the unwanted diffusion or evaporation of volatile ink constituents through the tubes' sidewalls by maintaining an equilibrious condition on either side of the tubes' sidewalls between the ink inside tube and the diffused volatile ink constituents that are disposed outside the tube but contained inside the sleeve.

9 Claims, 1 Drawing Sheet

INK-DELIVERY APPARATUS

TECHNICAL FIELD

The present invention relates generally to fluid delivery systems such as those found in ink-jet printers. More particularly, the invention concerns providing a flexible sleeve covering a plurality of flexible, ink-delivery tubes in a device such as an ink-jet printer where the tubes connect ink sources to a reciprocal carriage-mounted printhead where the sleeve is sealed together on either side of each tube to provide structural support for the tubes and to minimize diffusion of volatile ink constituents through the tubes' sidewalls.

BACKGROUND ART

Multiple ink-delivery tubes are necessary in ink-jet printers that use multiple sources of ink (e.g., multicolor) separated from a reciprocal carriage-mounted printhead. The tubes must connect the ink sources to the printhead in order to deliver the necessary ink, and must be sufficiently flexible to bend with the quick, back and forth movement of the printhead. Because these tubes are flexible and free to bend, they tend to twist and become tangled with each other.

The materials from which the ink-delivery tubes are manufactured represents a compromise of the conflicting functions of the tube. The ultimate goal of the tube is to deliver ink from ink sources to the printhead mechanism. However, the tubes must be sufficiently stiff to withstand the violent back-and-forth motion of the printhead over the life of the printer and yet also be flexible enough to minimize the wear on the carriage. The tube material must also be inert and not react with-the ink or any of the ink constituents. Moreover, the tube material should minimize the diffusion of volatile ink constituents because maintaining the proper concentrations of the various ingredients in the liquid ink is important in maintaining print quality. Diffusion could ultimately result in the ink "drying out" in the tube.

Previously, the twisting tendency of flexible, ink-delivery tubes during carriage motion has been overcome by using a multi-channel ganged silicone tube in a Cannon BJC-800 and BJC-820 printer. The multi-channel ganged silicone tube fails to reduce diffusion of volatile ink constituents to any significant extent.

DISCLOSURE OF THE INVENTION

Briefly, the invention provides a flexible sleeve which supports and holds multiple fluid-delivery tubes extending between one or more stationary fluid reservoirs and a moveable mechanism such as a printhead. The invention will prevent the unwanted twisting of the fluid-delivery tubes outside of their vertical planes during carriage motion, and in the event that a tube leak or failure does occur, liquid spray and leakage is minimized. In addition, the sleeve may be made out of material that minimizes the diffusion of volatile ink constituents through the tubes' sidewalls. These benefits may be provided with no significant addition to the weight or stiffness of the tubes and sleeve package.

The sleeve is preferably made of thin expanses placed on top and on bottom of the multiple laterally-spaced fluid-delivery tubes and heat-sealed on either side of each tube. The use of a sleeve made of thin expanses provides many advantages including low cost, ease of assembly and reduction of diffusion. The expanses are composed of outer polymer layers to provide the necessary seal and at least one inner layer for reduction of diffusion. Materials of this type are available at a relatively low cost. The assembly process would require placing the expanses on either side of the tubes and energizing heating elements or other bonding means to seal the material at the appropriate places. The improved diffusion barrier may enable the use of thinner-walled tubes or tube materials with lesser diffusion properties thereby minimizing carriage interactive forces and moments.

These and additional objects and advantage of the present invention will be more readily understood after consideration of the drawings and the detailed description of the preferred embodiment.

DETAILED DESCRIPTION OF THE PREFERRED EMBODIMENT AND BEST MODE OF CARRYING OUT THE INVENTION

Figure 1:
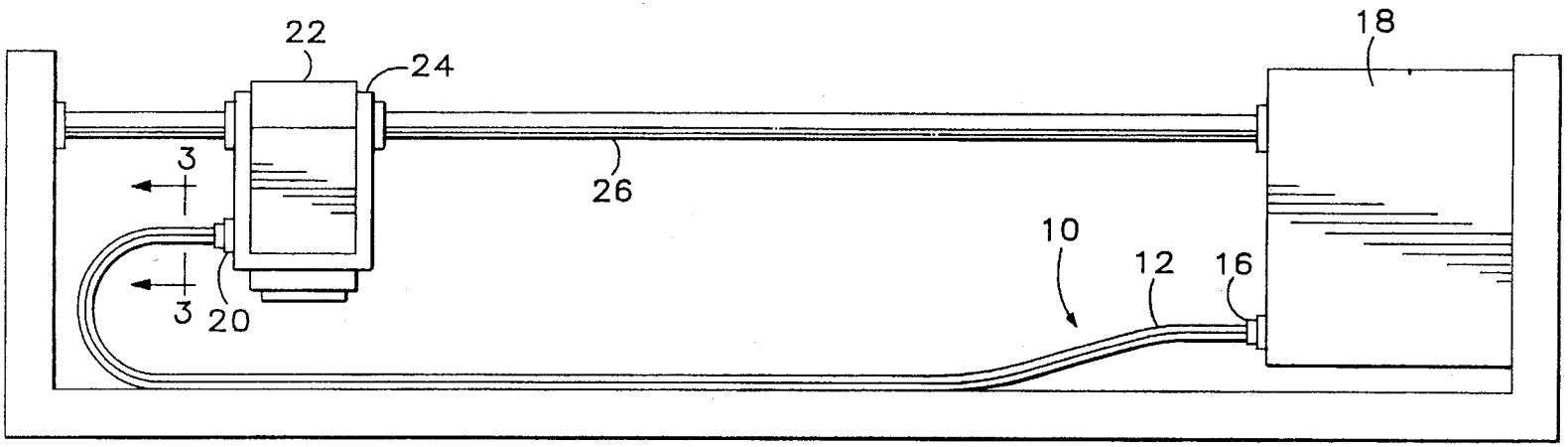
FIG. 1 is a fragmentary elevation of an ink jet printer showing ink sources, a reciprocable, carriage-mounted printhead and the invented sleeve for ink-delivery tubes.
Figure 2:
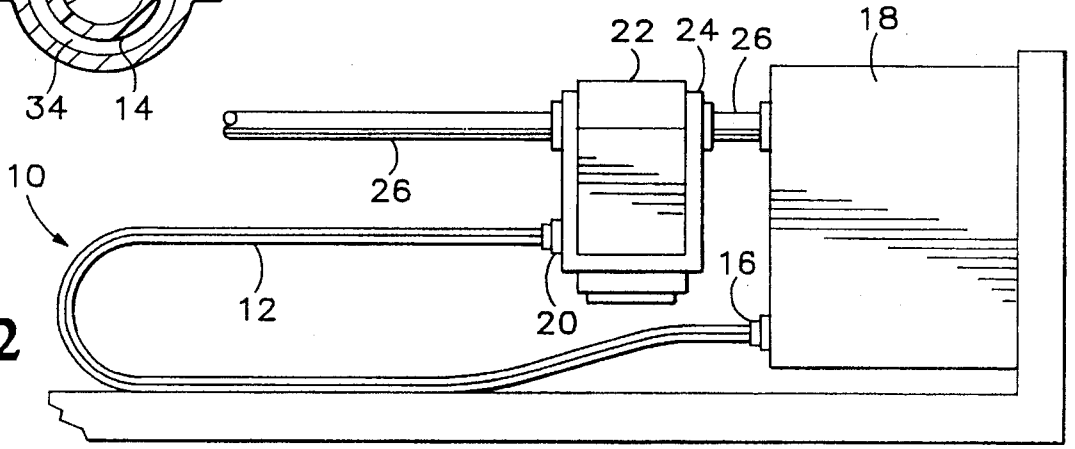
FIG. 2 is a fragmentary elevation corresponding to FIG. 1 but showing the printhead in a location closer to the ink sources and the corresponding reaction of the sleeve.
Figure 3:
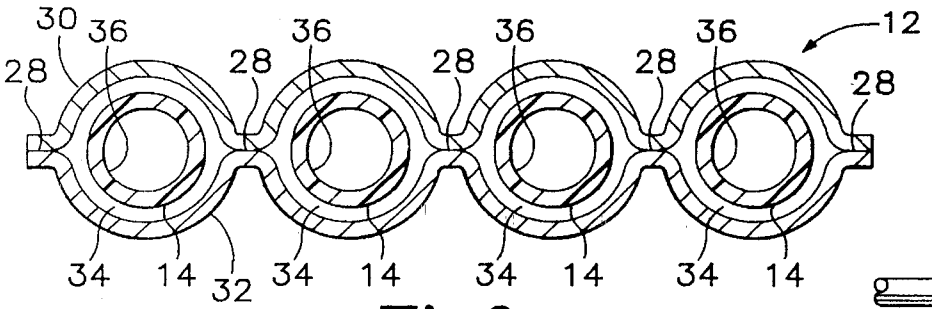
FIG. 3 is a sectional elevation taken generally along the lines 3—3 of FIG. 1 and shows the sleeve sealed around four flexible ink-delivery tubes.

Referring collectively to FIGS. 1 through 3, the invented apparatus in its preferred embodiment is indicated generally at 10. Apparatus 10 is useful in a device having one or more flexible tubes extending between a stationary fluid reservoir and a mechanism movable by carriage along a track. In one notable embodiment described and illustrated herein, the device is an ink jet printer, the fluid is ink and the mechanism is a printhead, as will be fully described below.

Apparatus 10 may be seen preferably to include a sleeve 12 which covers multiple, flexible, ink-delivery tubes 14. One end (i.e., source end), generally seen at 16, of the tubes is connected to one or more ink sources 18 via conventional secured, sealed coupling and the other end (i.e, target end), generally seen at 20, is connected to a movable mechanism 22, such as a printhead, via conventional secured, sealed coupling that is on a carriage 24 that moves along a track 26. The actual length and configuration of the apparatus is not important provided the ink-delivery tubes are sufficient to connect one or more ink sources to the movable printhead. FIGS. 1 and 2 demonstrate one possible configuration of the apparatus where apparatus 10 folds as printhead 22 nears ink sources 18, and the apparatus straightens out when the printhead moves away from the ink sources. Another possibility for the configuration of the apparatus is to allow the apparatus to "accordion" with movement of the printhead.

FIG. 3 shows a cross-sectional view of apparatus 10 with sleeve 12 surrounding tubes 14. In order to provide the necessary support and also the ability to prevent the tubes from twisting and tangling with one another, sleeve 12 is sealed as indicated, for example at 28, on either side of each tube. The invention is effective because an isolated or segregated tube does not twist and thus entangle another tube. FIG. 3 indicates that sleeve 12 is made of two layers or expanses 30 and 32, where one is on top of the tubes 14 and another is on the bottom. However, the same sleeve can be constructed out of one layer or laminate which is folded over where one region, e.g. expanse 30, is under tubes 14 and another region, e.g. expanse 32, is on top of the tubes. When sleeve 12 is sealed around each tube 14, a void 34 may be formed around each tube. In other words, each tube 14 is sealed in a chamber which includes void 34 around the tube. If the tubes are extremely flexible, the void 34 can be minimized to provide additional support for the tubes. However, if the tubes are rather stiff, as in the preferred embodiment, then the void 34 can be increased thereby not increasing the stiffness of apparatus 10 and not increasing the wear on printhead 22. Inside each tube, generally seen at 36, is a fluid such as ink which contains many conventional ink constituents, some of which are volatile. Water and alcohol are examples of some of the volatile ink constituents that may readily diffuse through to the tubes' sidewalls and evaporate in the atmosphere.

The flexible tubes 14 in apparatus 10 are diffusible to volatile ink constituents. If the tubes were indiffusible to volatile ink constituents, they would probably be too stiff and cause excessive .wear on printhead 22 or would react with the ink. Sleeve 12 allows the tubes to remain flexible and inert while reducing the diffusion of volatile ink constituents. Although volatile ink constituents diffuse through the tubes' sidewalls, void 34 formed by the seal around each tube 14 traps the volatile ink constituents. The ink's concentration and wetness is preserved by bringing the inner and outer sidewalls' surfaces' vapors into equilibrium.

An expanse may be constructed from any thin, flexible material that can be sealed around ink-delivery tubes. The preferred embodiment of an expanse has multiple thin layers of material with at-least one metalized inner layer for reduction of diffusion and at least one outer layer of heat-bondable polymer. In the preferred embodiment, the metal used for the metalized inner layer is aluminum and the polymer outer layers are polyethylene. The aluminum layer may be replaced by another metal or another material effective for diffusion abatement. The polymer layer may be replaced with an adhesive layer for the purpose of sealing the sleeve around the tubes. The expanse may contain layers of other material in addition to the minimum metalized inner layer and polymer outer layer. The needed anti-diffusion, e.g. metal, and bondable, e.g. polymer, layers alternatively might be formed integrally as a composite, single layer. All such alternative embodiments are within the spirit and scope of the invention.

Industrial Applicability

It may be seen then that the invented apparatus finds particularly utility in ink-jet printers, but that it is useful generally in any application wherein fluid-containing flexible tubes which are subject to twisting and undesirable diffusion of the liquid through the tube's sidewall. Tube twisting is eliminated by physically isolating each tube from each of the other tubes thereby preventing the tubes from entangling one another. Diffusion is minimized by use of a sleeve surrounding the tube. The sleeve is composed of material resistant to the diffusion or evaporation of volatile ink constituents.

While the present invention has been shown and described with reference to the foregoing preferred embodiment, it will be apparent to those skilled in the art that other changes in form and detail may be made therein without departing from the spirit and scope of the invention as defined in the appended claims.

We claim:

1. An ink-delivery apparatus for use in an ink-jet printer including one or more ink reservoirs and a reciprocable carriage-mounted printhead having one or more pens, the apparatus comprising:

a sleeve having a first expanse and a second expanse of flexible sheet material, wherein each of the first and the second expanses of sheet material are substantially impermeable to volatile ink constituents; and a plurality of substantially parallel elongate, flexible tubes for delivery of ink from one or more ink reservoirs to one or more pens of an ink-jet printer, the tubes include a source end connected to one or more ink reservoirs and a target end connected to one or more pens;

the tubes lying laterally spaced in relationship with one another between the first and second expanses such that the expanses are substantially coextensive with the tubes and extend therebetween;

the expanses bonding to one another along the substantial length of the expanses on either side of each tube such that each tube is isolated in a sealed chamber within which the tube is free to move;

each chamber including a void surrounding each tube, wherein each void holds volatile ink constituents that may diffuse through the tubes but the ink constituents being trapped by the expanses and the void enhances overall flexibility of the tubes and sleeve so that wear on the reciprocable carriage-mounted printhead is reduced.

2. The apparatus of claim 1, wherein each of the first and the second expanses of sheet material is a laminate having outer polymer layers.

3. The apparatus of claim 2, wherein the outer polymer layers include polyethylene.

4. The apparatus of claim 1, wherein each of the first and the second expanses is a laminate having at least one metalized layer.

5. An ink-delivery apparatus for use in a printer including one or more ink sources and a movable print mechanism, the apparatus comprising:

a plurality of elongate, flexible, substantially parallel tubes for delivery of ink from one or more ink sources to a movable print mechanism, the tubes include a source end connected to one or more ink sources and a target end connected to the movable print mechanism; and a sleeve of thin, flexible laminate, wherein the sleeve is substantially impermeable and indiffusible to volatile ink constituents;

the tubes being laterally-spaced relative to each other and interposed within the sleeve such that the sleeve is substantially coextensive with the tubes;

the tubes being physically segregated from each other by sealing the sleeve together on either side of each tube along substantial length of the sleeve, such that each tube is isolated in a sealed chamber within which each tube is not affixed to the other tubes and not affixed to the sleeve;

each chamber including a void surrounding each tube, wherein each void holds volatile ink constituents that may diffuse through the tubes but the ink constituents being trapped by the sleeve and the void enhances overall flexibility of the tubes and sleeve so that wear on the movable print mechanism is reduced.

6. The apparatus of claim 5, wherein the sleeve has outer polymer layers.

7. The apparatus of claim 6, wherein the outer polymer layers include polyethylene.

8. The apparatus of claim 5, wherein the sleeve has at least one metalized layer.

9. A ink-delivery apparatus for use in an ink-jet printer including one or more ink reservoirs and a reciprocable carriage-mounted printhead having one or more pens, the apparatus comprising:

a sleeve having a first expanse and a second expanse of flexible sheet material, wherein each of the first and the second expanses of sheet material are substantially indiffusible to volatile ink constituents and wherein each of the first and the second expanses of sheet material is a laminate having outer polymer layers and at least one metalized layer;

a plurality of substantially parallel elongate, flexible tubes for delivery of ink from one or more ink reservoirs to one or more pens of an ink-jet printer, the tubes including a source end connected to one or more ink reservoirs and a target end connected to one or more pens;

the tubes lying laterally spaced in relationship with one another between the first and second expanses such that the expanses are substantially coextensive with the tubes and extend therebetween;

the expanses bonding to one another along substantial length of the expanses on either side of each tube such that each tube is isolated in a chamber in which the tube is free to move;

each chamber including a void surrounding each tube, wherein each void holds volatile ink constituents that may diffuse through the tubes but the ink constituents being trapped by the indiffusible expanses and the void enhances overall flexibility of the tubes and sleeve so that wear on the reciprocable carriage-mounted printhead is reduced.

* * * * *